United States Patent [19]

David

[11] 4,319,685

[45] Mar. 16, 1982

[54] OPENWORK CRATE FOR TRANSPORTING BOTTLES OR THE LIKE

[76] Inventor: Pierre A. David, 18 Rue Jacquot Defrance, 54520 Laxou, France

[21] Appl. No.: 111,066

[22] Filed: Jan. 10, 1980

[30] Foreign Application Priority Data

Jan. 17, 1979 [FR] France ..... 79 01118

[51] Int. Cl.[3] ..... B65D 21/04; B65D 1/24

[52] U.S. Cl. ..... 206/507; 206/509; 206/427; 220/21

[58] Field of Search ..... 206/505, 506, 507, 509, 206/203, 427; 220/21

[56] References Cited

U.S. PATENT DOCUMENTS

| | | | |
|---|---|---|---|
| 3,481,507 | 12/1969 | Sanders | 206/507 |
| 3,791,549 | 2/1974 | Delbrouck | 206/509 |
| 3,934,724 | 1/1976 | Johnson | 206/507 |
| 4,101,049 | 7/1978 | Wallace | 206/507 |

FOREIGN PATENT DOCUMENTS

| | | | |
|---|---|---|---|
| 2313274 | 12/1976 | France | 206/507 |
| 2017645 | 10/1979 | United Kingdom | 206/203 |

*Primary Examiner*—George E. Lowrance

*Attorney, Agent, or Firm*—Sughrue, Mion, Zinn, Macpeak and Seas

[57] ABSTRACT

The crate is capable of being fitted in other crates to form a stack. The crate comprises an upper girdle portion, an apertured buttom portion, and lateral walls and inner partition walls formed by inclined arms which may form a vertical geometric projection in the empty spaces of the bottom portion in the plane of the latter. These arms form surfaces of pyramids for maintaining and separating the bottles or the like. The inclined arms are capable of sliding on those of another crate when a plurality of crates are fitted together. At least a part of the apices of the inclined arms is capable of coinciding of solid parts of the apertured bottom portion of an identical crate which is placed in a different orientation above the first crate.

13 Claims, 8 Drawing Figures

OPENWORK CRATE FOR TRANSPORTING BOTTLES OR THE LIKE

DESCRIPTION

It is known to employ for transporting food products, for example bottles, cheese or the like, cases or crates which are usually of plastics material and comprise inner partition walls which isolate the transported objects from one another and prevent them from moving or striking against one another in the course of handling. Such crates have an overall height which slightly exceeds that of the objects they contain. They may be stacked on one another, but when they are empty they occupy the same volume as when they are full, which is a drawback for their storage between two uses and even for their return empty when they have been used for transporting objects supplied in disposable packings.

An object of the present invention is to provide an improved crate which avoids these drawbacks and permits a reliable transportation and a storage or return in a minimum volume.

According to the invention there is provided a openwork crate which comprises an apertured bottom portion, outer partition walls formed by arms which are inclined in pairs in opposite directions, and inner partition walls also formed by arms which are inclined in two opposed directions, said arms extending from solid parts of the bottom portion and being united at their apex with at least another inner or outer arm so that their upper portions may form a vertical geometric projection inside the empty spaces of the bottom portion in the plane of the latter.

Preferably, an outer upper girdle portion is carried by the arms of the outer partition walls. With this arrangement, the objects which rest on the solid parts of the apertured bottom portion are separated from one another and maintained by a plurality of inclined arms with which they are in contact, said plurality of inclined arms interconnected at their apex forming hollow pyramids which are open at their base. A plurality of identical crates can consequently fit one inside the other in a small volume when they are empty, the pyramids of one extending into the pyramids of the other. On the other hand, when they are full, they may be superimposed on one another after the re-orientation of each one thereof about a vertical axis relative to the preceding one of the stack, the lower ends of the arms of one crate bearing against the apices of the corresponding arms of the lower crate. In one embodiment, the inner arms have the same height as the outer arms and the bottom portion of the upper crate can bear on all of the apices of the pyramids formed by these arms so that the stack is made stronger.

In another embodiment, the arms of the inner partition walls are shorter than those of the outer wall but they have a constant vertical thickness so that the fitting and stacking of the crate with similar other crates remains possible.

The ensuing description of embodiments given merely by way of examples and illustrated in the accompanying drawings will bring out the features and advantages of the invention more clearly.

Figure 1:
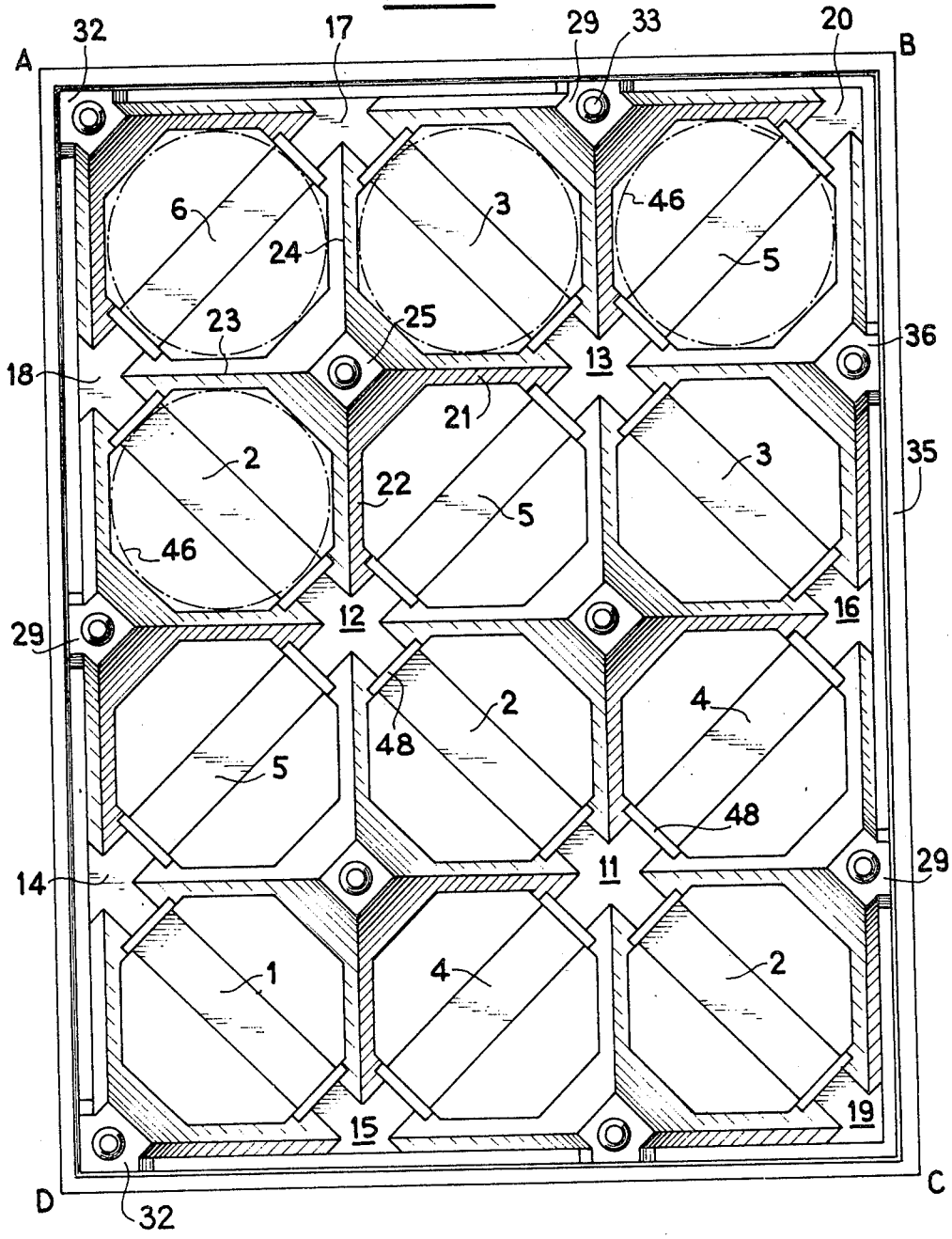
FIG. 1 is a top plan view of a rectangular crate according to the invention which has a capacity of a dozen bottles.
Figure 2:
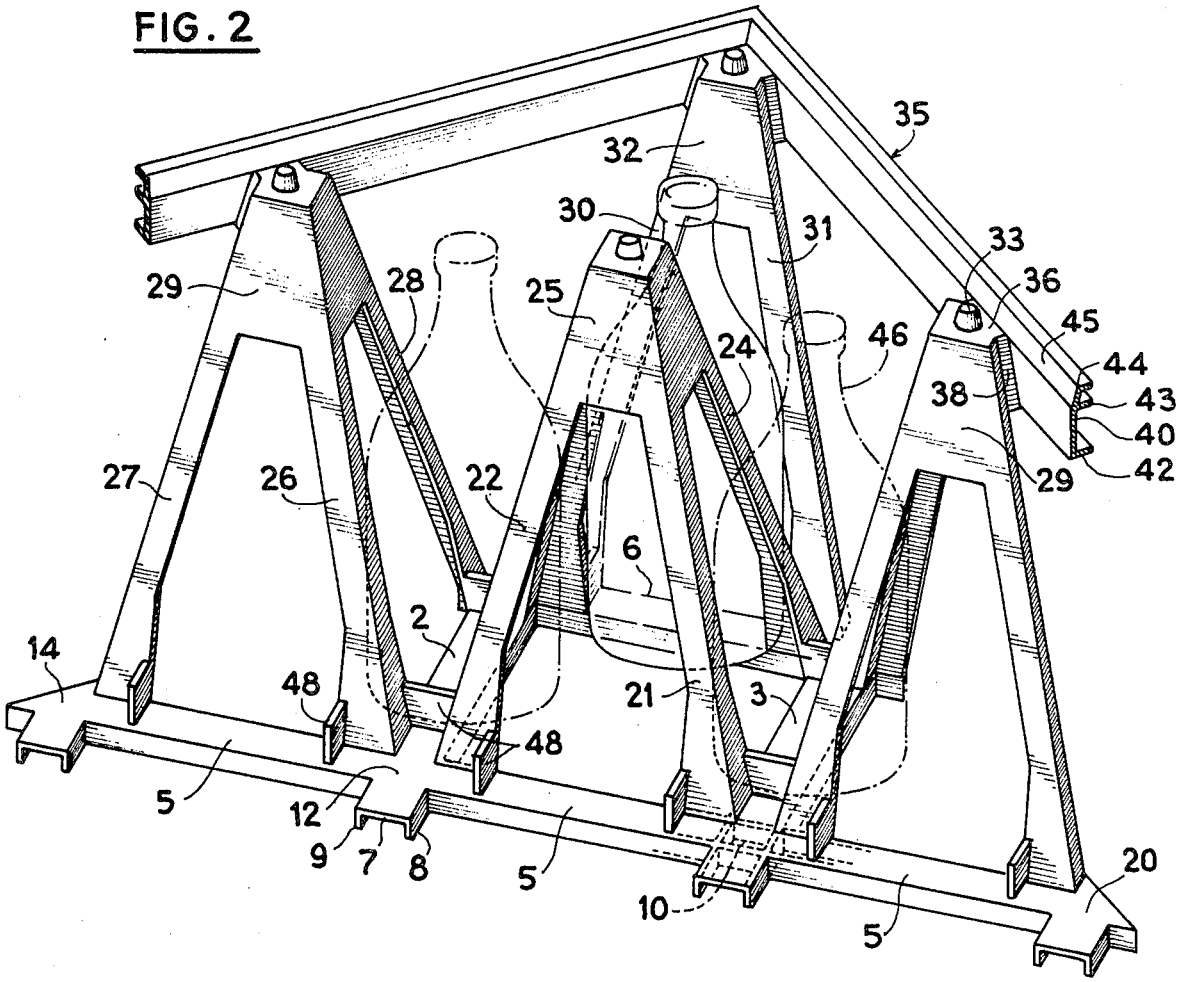
FIG. 2 is a perspective view of one corner of the crate of FIG. 1 showing how the bottles are placed in position.

In a first embodiment, shown in FIGS. 1 and 2, a case or crate according to the invention comprises an openwork bottom portion formed by two series of parallel cross-members 1, 2, 3 and 4, 5, 6, which intersect at a right angle.

Each of these cross-members is formed by a U-section member having a web 7 and two lower lateral flanges 8 and 9 which increase its bending strength. These flanges interpenetrate at the crossing point of the two cross-members and consequently define a cavity 10 therebetween which has a square section and is open at its base and closed in its upper part by the coinciding webs 7 of the crossing cross-members (FIG. 2).

The cross-members 1, 2 and 3, or 4, 5 and 6 of the same series are spaced equal distances apart and the distance between the cross-members 1 and 2 or 2 and 3 is the same as that between the cross-members 4 and 5 or 5 and 6. The assembly of the cross-members is moreover inscribed in an imaginary rectangle whose sides make an angle of 45° with each of the cross-members 1, 2, 3, 4, 5 or 6. The assembly of these cross-members thus forms a network having square meshes in its centre part and incomplete triangular meshes along its edges the periphery of which carries end nodal portions.

In the embodiment illustrated in FIG. 1, the network comprises three centre nodal portions 11, 12 and 13 formed at the intersection of the cross-members 2 and 4, 2 and 5 and 5 and 3, five end nodal portions 14, 15, 16, 17 and 18 respectively located at the junction of the ends of the cross-members 5 and 1, 1 and 4, 4 and 3, 3 and 6, 6 and 2, and furthermore two end nodal portions 19 and 20 formed by the three ends of the cross-members 2 and 5. The number of end nodal portions located on the periphery of the bottom portion of the crate at equal distances from one another along this periphery, is therefore an odd number, namely seven in the presently described embodiment.

Extending from each nodal portion are inclined arms which form the inner and outer partition walls of the crate. Each of the arms is fixed at its base to two adjacent cross-members of the nodal portion and projects inwardly of the crate and converges toward the arm or the arms fixed to the adjacent nodal portions of the same mesh. Thus the square mesh defined by the cross-members 5, 2, 6 and 3 connected to the nodal portions 12, 18, 17 and 13 supports a truncated pyramid formed by four arms 21, 22, 23 and 24 each of which extends from one of the corners of this mesh. The arms 21, 22, 23 and 24 are convergent and united at their apex at 25. In the same way, the other square meshes of the crate shown in FIG. 1 each support a pyramid formed by four arms fixed in the corners of this mesh. The triangular meshes also support inclined arms which are interconnected at their apex and form portions of a pyramid. For example, the triangular mesh formed by the cross-member 5 and the cross-member 2 of FIG. 2 supports three arms 26, 27 and 28 which are interconnected at 29 at their apex. In the same way, upwardly convergent arms 30 and 31 interconnected at their apex 32 extend from the two ends of the cross-member 6 in the region of the nodal portions 18 and 17.

Irrespective of the number of arms they possess, the pyramids or portions of a pyramid are such that they are projected horizontally in the apertured parts of the bottom portion; consequently, the apices 29 or 32 of the outer partial pyramids are substantially in alignment with the nodal portions 14 and 18 or 17 and 20 for example.

Preferably, each of the inclined arms is formed by an L-section member whose flanges are each rigid with one of the adjacent cross-members. The width of these flanges is greater in the lower part of the arm then in the centre part thereof as can be clearly seen in FIG. 2. Consequently, each of the pyramids formed by the arms has sides which are parallel to the cross-members and are notched in a polygonal shape. At their apex, these sides are truncated and interconnected at 25, 29 or 32 by a head portion whose side has a length substantially equal to the width of the cross-members.

Each of the head portions 25, 29 or 32, whether it be square or triangular, carries at its centre a centering stud 33 having a frustoconical profile and a diameter at the base which is slightly less than the inner width of the cavity 10 formed at the crossing of the cross-members. The height of this stud is equal to, or slightly less than, the height of the flanges 8 and 9 of the same cross-members. These studs 33 in the same way as the apices of the pyramids, are arranged around the whole of the circumference of the crate at equal distances between the end nodal portions 17, 20, 16, 19, 15, 14 and 18. They are consequently in an odd number, namely seven in the embodiment shown in FIGS. 1 and 2.

In the upper part of the crate around the head portions 29 and 32 of the partial pyramids there is fixed a girdle portion 35 which is connected to each of these heads 29 and 32 by a horizontal extension 36 and two inclined lateral tongue portions 38. The girdle portion 35 has a vertical skirt portion 40 which is rigid with the tongue portions 38 and with the extension 36 on one of its sides and which is extended on its other side by three ribs 42, 43 and 44 respectively. The three ribs 42, 43 and 44 are parallel to each other but the rib 44 is slightly outwardly set back relative to the rib 43 and is connected to the latter above the skirt portion 40 by an inclined wall 45. The girdle portion 35 is consequently outwardly flared above the head portions 29 and 32 to the height of the studs 33.

When a crate such as that described is used, bottles 46 are vertically inserted between the pyramids formed by the inclined arms. They enter the notches of the sides of these pyramids and rest against the bottom cross-members of the crate. The distance between the parallel cross-members or that which separates the successive partition walls formed by the inclined arms parallel to the same cross-member, substantially corresponds to the outside diameter of a bottle so that in entering the notches of the sides of two opposed pyramids, the bottle comes in contact with the four arms which define these notches. It is guided by these arms throughout the insertion of the bottle.

Preferably, vertical lugs 48 interconnect the adjacent arms of the same nodal portion above the cross-member, for example a lug 48 interconnects the arms 22 and 26 above the cross-member 2 and another lug 48 connects the arm 26 to the adjacent arm above the cross-member 5. Each of the bottles 46 is thus held stationary at its base between two lugs 48 which are carried by the cross-member on which it rests. This bottle is moreover tangent to the inclined arms which define the notches of the two sides of the pyramid which it penetrates. These arms are in contact with the bottle at approximately mid-way of its height, that is to say in the region of its centre of gravity when it is full and consequently it has high stability in the course of handling.

As clearly shown in FIG. 2, the pyramids formed by the inclined arms have a height which is slightly greater than that of the bottles 46. Consequently, the bottles are, during transport, not only maintained stationary, but protected by these pyramids. Further, when the crate shown in FIG. 1 is filled with bottles 46, another identical crate may be stacked thereon after having pivoted it through an angle of 180° about a vertical axis so as to bring the nodal portions 19 and 20 of the upper crate in coincidence with the head portions 32 of the lower crate. In this way, the studs 33 of the head portions 32 enter the cavities 10 of the nodal portions 19 and 20 and the crates are exactly centered with respect to each other. The flared shape of the wall 45 facilitates the insertion and the centering of the crates. Further, as all the pyramids carry a stud 33, each of the nodal portions of the upper crate is fitted on this stud and bears on the lower crate. In this way, there is obtained a stack which is not only exactly centered but also has the great strength of a triangulated structure.

When the crate has been emptied by the withdrawal of the bottles 46, the crates may be fitted one inside the other in an exactly superimposed arrangement. The inclined arms of one of the crates slides along the inclined arms of the immediately lower crate whereas the cross-members of the bottom portion bear against the vertical lugs 48. As the crates are oriented in exactly the same direction, they are easily fitted together.

Figure 3:
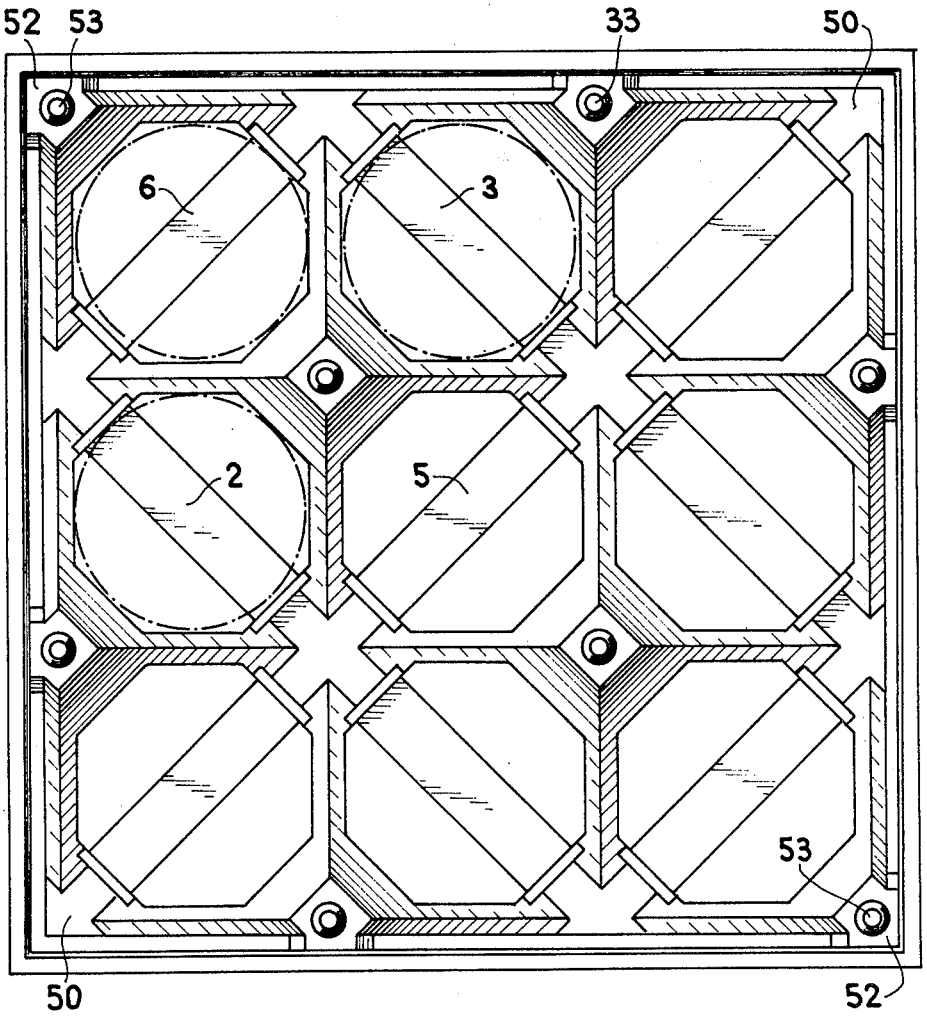
FIG. 3 is a top plan view similar to FIG. 1 of a square crate.

The crate shown in FIG. 1 is inscribed in a rectangle so that the two opposed corners are formed, one by a partial pyramid, the other by a nodal portion, but the crate of the invention may also be inscribed in a square as shown in FIG. 3. This crate is constructed in the same way as that of FIG. 1 and also comprises an apertured bottom portion formed by cross-members which cross each other at a right angle. Extending from the nodal portions of these cross-members are inclined arms which form outwardly projecting pyramids. However, the arrangement of the triangular meshes on the periphery of the crate is the same on each of the sides thereof so that in the opposed corners there are either two nodal portions 50 or two pyramids 52 provided with studs 53. Consequently, when these crates are full, for the purpose of stacking them, the upper crates must be turned through an angle of only 90° about a vertical axis through its center. The stack is then created in the same way as in the foregoing case, each of the studs 53 entering a cavity 10 of the nodal portions of the upper crate. On the other hand, when the crates are empty, they may be fitted one inside the other in the same way as before, while remaining oriented in the same direction.

The inclined arms of the square crate are, as the arms of the rectangular crate, formed by L-section members so that the sides of the pyramids are notched and the bottles extend into these pyramids. In such an arrangement, the distance between the bottles is a function of the thickness of the arms in their median part, that is to say in the part which is in contact with the bottles.

Figure 5:
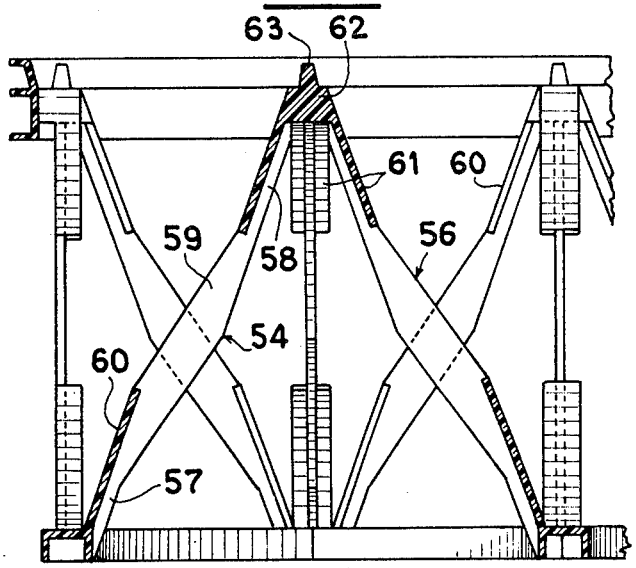
FIG. 5 is a sectional view taken on line 5—5 of FIG. 4.
Figure 4:
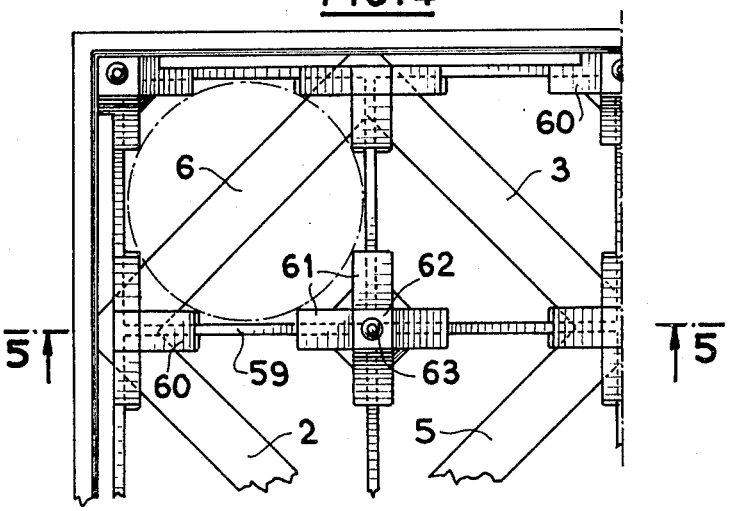
FIG. 4 is a top plan view of a corner of a crate according to a modification.

According to another embodiment, in order to reduce the distance between the bottles and enable the crate to be adapted to bottles of larger diameter, the arms are given a flattened shape in their median part as shown in FIGS. 4 and 5. In such an arrangement, each of the inclined arms 44 or 46 has in its end portions, both in its upper portion and in its lower portion, a T-section shape. The webs 57 and 58 of these Ts are interconnected by a centre portion 59 of greater height. Each of the lower Ts is fixed to a nodal portion of the bottom portion of the crate. The web 57 extends on the bisector of the angle formed by two adjacent cross-members, whereas the transverse bars 61 of each of the Ts are located on the exterior and are rigid with the sides of a square head portion 62 carrying a stud 63.

Figure 7:
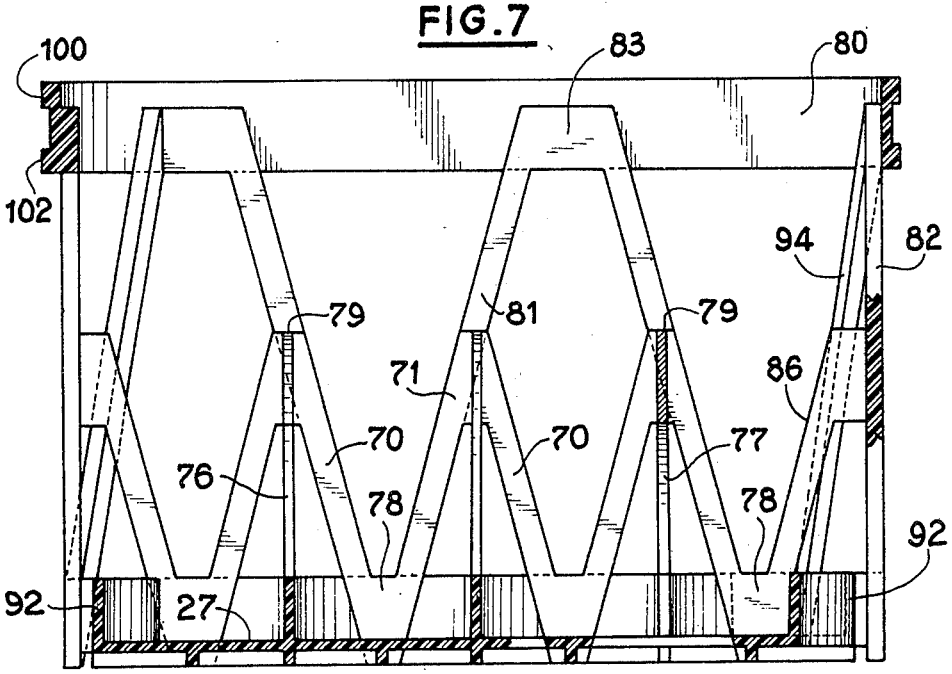
FIG. 7 is a vertical sectional view taken on line 7—7 of FIG. 6.
Figure 6:
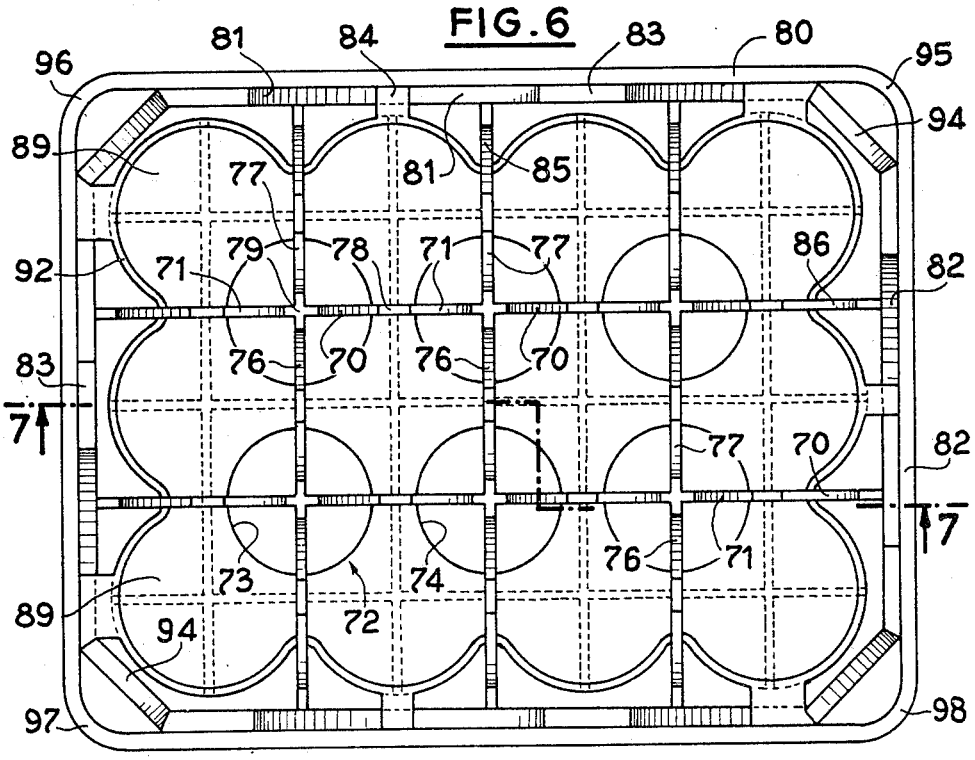
FIG. 6 is a top plan view of a crate according to another embodiment.
Figure 8:
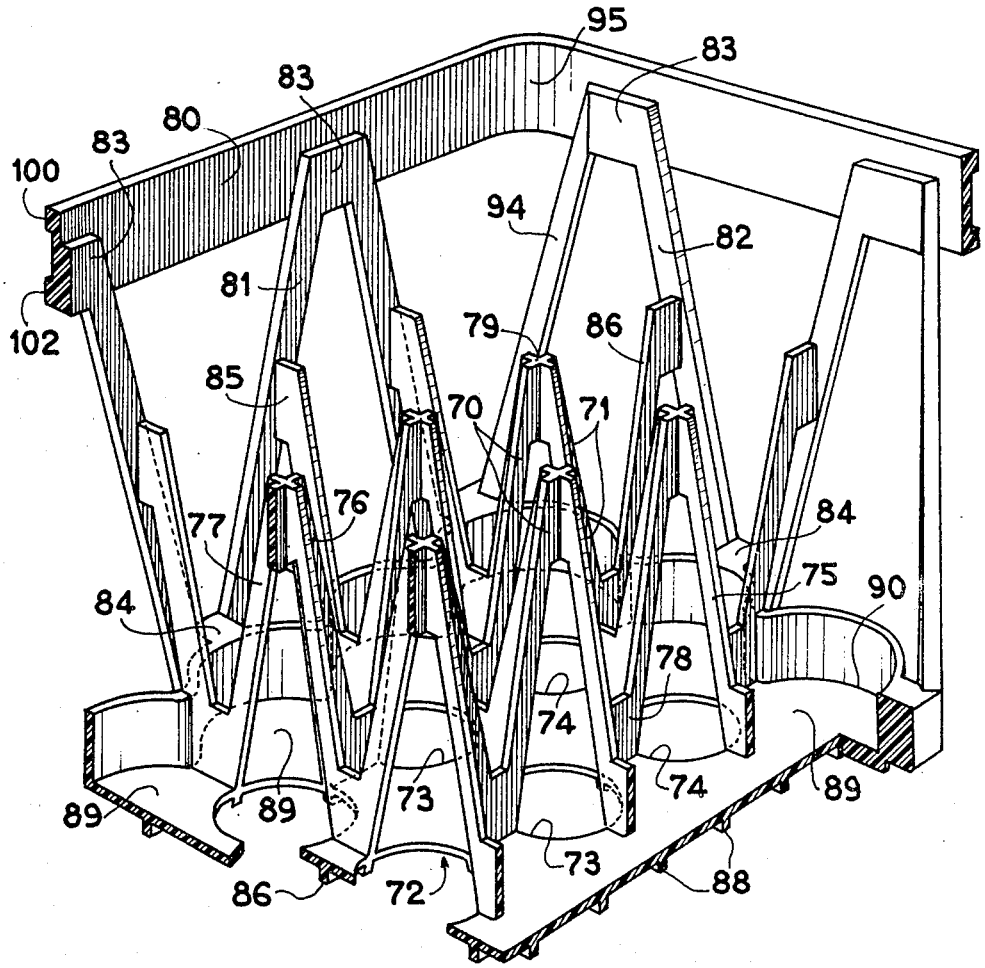
FIG. 8 is a partial perspective view of the crate of FIGS. 6 and 7.

These arms, as the foregoing arms, form pyramids and permit the stacking of the crates when they are full or the fitting together of these crates when they are empty. The height, when measured in a vertical plane, of the different sections of the inclined arms, remains constant so as to facilitate the fitting together;

The construction of the crate may be still further simplified by employing inclined arms which are flat throughout their length and have a rectangular cross-sectional shape as shown in FIGS. 6, 7 and 8. These arms are then preferably fixed, not to the nodal portions of the cross-members, but at a point which is intermediate of these nodal portions so that the objects or bottles rest on the nodal portion itself between four adjacent pairs of arms. Indeed, in this case, two arms 70, 71 extend from the same point of the bottom portion 72 of the crate between two empty spaces 73 and 74. These arms, which extend in opposite directions, are connected at their apices above each of the corresponding empty spaces 73 and 74, on one hand, to an arm 70 or 71 which is in alignment therewith, and, on the other hand, to two arms 76 and 77 which extend in a direction perpendicular to all the arms 70 and 71. In this way this crate has two series of inner partition walls respectively parallel to the large and small sides of the crate.

At their base, the adjacent arms 70 and 71 are interconnected by a gusset 78 of a certain height so as to provide the bottle or the object placed on the bottom portion 72, a sufficient support surface. Each of these objects is indeed in contact with four vertical gussets 78 which maintain it laterally.

It will be understood that the height and the inclination of the arms 70, 71, 76, 77 may be chosen in such manner as to place their apices 79 at the height of the girdle portion 80 of the crate, in the same way as the apices 29, 32 of the crate of FIG. 2. However, in some cases, it might be preferable to give a shorter length to these arms as shown in FIGS. 7 and 8, the thickness of the arms and their inclination being such that they have a constant thickness, measured in the vertical direction, so that the fitting of the crate into a similar other crate is always possible.

In this embodiment, the outer arms 81, 82 have a section similar to the inner arms, that is to say a rectangular section. They are interconnected in their upper part by gussets 83 which are fixed to the girdle portion 80 and in their lower part by gussets 84 which are fixed to the bottom portion 72 of the crate.

In a preferred embodiment, the pyramids formed by the arms 71, 70, 76 and 77 have a height which is substantially equal to one half of the overall height of the crate, and the end arms 85 or 86 of the partition walls are fixed at mid-height to the inclined arms 81 or 82 of the outer walls respectively of the large and small sides of the crate.

Owing to the particular shape of the objects, in particular bottles, for the transportation of which the crate is intended, it is often preferable to replace the bottom portion formed by the crossing cross-members by a bottom portion which is merely provided with circular openings such as the openings 73 and 74 shown in FIGS. 6 to 8, the arms 70 and 71, and the gussets 78 interconnecting them, extending from the narrow part of the bottom portion which is located between the spaces or openings 73 and 74, whereas the apices 79 of the pyramids are projected in these spaces. Such a bottom portion may be moreover reinforced by ribs 87, 88 which are respectively perpendicular to the large and small sides of the crate and project from the lower side of the bottom portion 72 and reinforce the latter. The objects are then disposed on a relatively large solid part 89 of the bottom portion 72 between four gussets 78 and may extend beyond the apices 79 inside the crate. A second crate similar to the first may moreover by placed on the apex of the upper gussets 83 of the arms and be in this way correctly stacked on the first crate.

Preferably, the peripheral surface of the bottom portion 72 provided with circular openings 73 and 74 is cut out in the form of arcs of a circle 90, or similar contours corresponding to the shape of the objects to be transported. A flange 92, which has a height substantially to that of the gussets 78 is then preferably fixed to the bottom portion 72 along the contours 90 the shape of which it conforms to so that it can maintain the objects in position.

Further, the outer partition walls of the crate which are, as the inner partition walls, formed by arms inclined in opposite directions, are interconnected in the corners of the crate by an arm 94 whose general direction intersects the corner of the girdle portion and makes an angle of about 45° with each of the sides of the latter.

It will be understood that in the different successive corners 95, 96, 97 and 98 of the crate, the arms 94 have inverted inclinations so that the series of V-shaped structures formed by the arms 81, 82, 94, which are inclined alternately in one direction and then the other, is continuous throughout the circumference of the crate and that this series has an axis of symmetry passing through the geometric center of the inner surface of the injecting moulds for the crate.

The outer inclined arms may also be constructed with a section which varies along their height and in particular a section which is internally reinforced in the middle part thereof and is more resistant to compressive stress, this reinforcement being located between the transported bottles or objects without this increasing the overall size of the crate.

Having now described my invention what I claim as new and desire to secure by Letters Patent is:

1. A rectangular openwork crate which is capable of being nested in another identical crate in a nesting position and is stackable with said other identical crate when turned about a vertical centre axis of the crate from the nesting position, the crate comprising in combination a horizontal apertured bottom portion of the corresponding pyramids of said other crate in said nesting position.

2. A crate as claimed in claim 1, wherein the pyramids have the same height as the outer arms.

3. A crate as claimed in claim 1, wherein the pyramids have a height less than the height of the outer arms, the inner arms of the inner partition walls being connected to the outer arms of the outer walls at substantially mid-way of the height of the outer arms of the outer walls.

4. A crate as claimed in claim 1, 2 or 3, wherein at least the inclined outer arms of the outer walls extend up to substantially a top plane of the crate and have their upper end portions which are symmetrical with the lower end portions of the outer arms of the outer walls relative to the vertical center axis of the crate.

5. A crate as claimed in claim 1, wherein an outer peripheral girdle portion interconnects the upper end portions of the outer arms of the outer walls.

6. A crate as claimed in any one of the claims 1, 2 or 3 wherein the arms have a rectangular horizontal section.

7. A crate as claimed in claim 1, wherein in each corner of the crate the outer wall comprises an inclined arm which is located in a plane making an angle of substantially 45° with each one of the adjacent sides of the corresponding corner of the crate and is connected at the upper end portion thereof and at the lower end portion thereof respectively to the neighbouring inclined arms of said adjacent sides.

8. A crate as claimed in claim 1, 2 or 3, wherein the arms have an L-shape in horizontal section and an upper end portion in the shape of a truncated pyramid.

9. A crate as claimed in claim 1, wherein said parallel inner partition walls are spaced apart a distance corresponding to the outside diameter of said object which is cylindrical so that the inclined arms each form, in the vicinity of a median part thereof, a support extending tangentially of the object which is in this way maintained in position in the region of its center of gravity at four equally spaced apart points of its circumference.

10. A crate as claimed in claim 2 or 3, wherein outer elements of the crate have a U-shaped cross-section.

11. A crate as claimed in claim 1, 2 or 3, wherein the bottom portion is formed by crossing cross-members.

12. A crate as claimed in claim 1, 2 or 3, wherein the bottom portion is formed by an apertured panel having a vertical flange extending around the periphery of the panel.

13. A crate as claimed in claim 12, wherein the periphery of the bottom portion defines a series of arcs and the flange conforms to the contour of the arcs.

* * * * *